United States Patent [19]

Dobson, Sr.

[11] Patent Number: 4,795,495

[45] Date of Patent: Jan. 3, 1989

[54] SEWER CLEANING DEVICE

[75] Inventor: Michael K. Dobson, Sr., Streamwood, Ill.

[73] Assignee: Village of Streamwood, Streamwood, Ill. ; a part interest

[21] Appl. No.: 786,626

[22] Filed: Oct. 11, 1985

[51] Int. Cl.[4] ..... B08B 9/04

[52] U.S. Cl. ..... 134/8; 134/22.1; 134/22.11; 15/104.09; 15/104.14; 15/104.15; 15/236 R

[58] Field of Search ..... 134/22.1, 22.11, 22.12, 134/24, 167 R, 10, 13, 8; 15/302, 104.3 R, 104.09, 104.14, 104.15, 141 RA, 236 R, 236 C, 104.16, 200

[56] References Cited

U.S. PATENT DOCUMENTS

| | | | |
|---|---|---|---|
| 1,837,423 | 12/1931 | Foster | 15/104.14 |
| 2,812,531 | 12/1957 | Ashley | 134/8 |
| 3,128,827 | 4/1964 | Kluck | 15/104.16 |
| 3,535,161 | 10/1970 | Gutrich | 134/24 |
| 3,600,225 | 8/1971 | Parmelke | 134/22.12 |
| 3,658,589 | 4/1972 | Shaddock | 134/24 |
| 4,206,313 | 6/1980 | Cavoretto | 134/24 |
| 4,225,362 | 9/1980 | Sentell | 134/24 |
| 4,356,039 | 10/1982 | Clifford | 134/8 |
| 4,578,198 | 3/1986 | Schmidt et al. | 134/10 |

*Primary Examiner*—H. M. S. Sneed
*Assistant Examiner*—Sharon T. Cohen
*Attorney, Agent, or Firm*—Mathew R. P. Perrone, Jr.

[57] ABSTRACT

A sewer cleaning device having an inlet nozzle assembly at one end for securing to a sewer jet and a sealed nozzle assembly oppositely disposed therefrom with water flowing from the sewer jet through each nozzle assembly and cables secured to a central housing between the nozzle assembly provides for a scraping and water jet action to clean a sewer pipe thoroughly.

20 Claims, 2 Drawing Sheets

SEWER CLEANING DEVICE

BACKGROUND OF THE INVENTION

This invention relates to a device for cleaning sewers, and more particularly to an attachment for a sewer jet which uses both high pressure water nozzles and scraping cable tools to clean out the sewer.

Sewers are an essential part of life in urban society and receive sewage and other waste. In fact, many places where there is a reasonably heavy concentration of population, sewers are the most efficient means of disposing of waste. With the operation of sewers, come a substantial number of problems.

Many items can clog and otherwise hinder the function of a sewer. Typical of these items are grease and laundry detergents which form on the surface of the water and tend to clog the top of a sewer pipe. Solid items also collect in the sewer and have a tendency to clog the bottom half of the sewer. When these various clogging materials and sewage solidify in a sewer, the sewer becomes stopped at great inconvenience to the community and the parties using the sewers. In fact, such blockages are a substantial danger to health. It, therefore, becomes clear that it is highly desirable to have a device for cleaning out the sewers.

One typical device for cleaning a sewer is a power rod. The power rod basically involves running a stiffened rod through the sewer pipe to break up any severe clogs or sever blockages. These clogs have a tendency to block the sewer and can be penetrated by the power rod. However, the power rod for the most part only pokes a hole in the clog without substantially destroying or removing the clogged mass. Thus, the power rodding lacks a complete cleaning capability for the sewer.

Another disadvantage of the power rod is that it is substantially rigid. While the rigidity helps to break up severe clogs, it is difficult to use the sewer rod to reach a wide range of areas—especially in sewer pipes with bends in them. In other words, the power rod is suitable for use only in substantially straight lengths of sewer pipe.

Another device in common use to clean out a sewer is a sewer jet. A sewer jet is basically a flexible hose which squirts water at high pressure against the various clogs and other blockages in a sewer to break up the clogs and objects. Even this high pressure water is sometimes no more successful than a power rod because only a hole is punched in the clog. The flexibility of the sewer jet permits greater maneuverability, but lacks the force to break through the very severe clog.

Thus, it is highly desirable to form a device capable of breaking through a severe clog in a sewer pipe and doing a more thorough cleaning of the sewer pipe.

SUMMARY OF THE INVENTION

Therefore, it is an object of this invention to provide a device for thoroughly cleaning a sewer pipe.

A further object of this invention is to provide a device for breaking up clogs in a sewer.

A still further object of this invention is to provide a method for more thoroughly cleaning a sewer.

Yet a further object of this invention is to provide a method for breaking up clogs in a sewer.

These and other objects of the invention (which other objects become clear by considering the specification drawings and claims as a whole) are met by providing a sewer cleaning device having an inlet nozzle assembly at one end for securing to a sewer jet and a sealed nozzle assembly oppositely disposed therefrom with water flowing from the sewer jet through each nozzle assembly and cables secured to a central housing between the nozzle assembly to provide for a scraping and water jet action to clean a sewer pipe thoroughly.

BRIEF DESCRIPTION OF THE DRAWINGS

FIG. I is a perspective view of sewer cleaning device 10.

FIG. II depicts an end view of rear or inlet nozzle housing 50.

Figure 1:
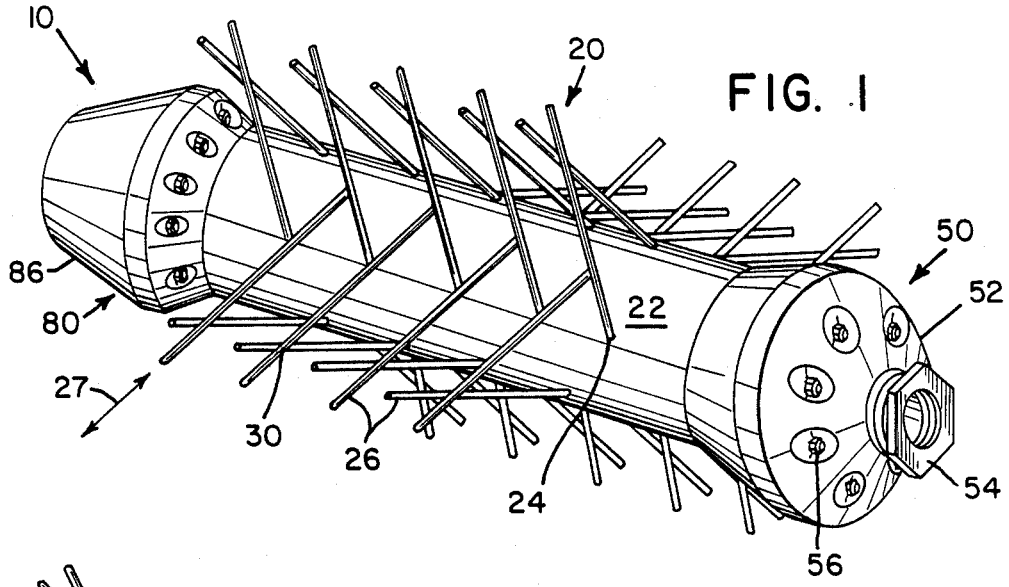
Figure 2:
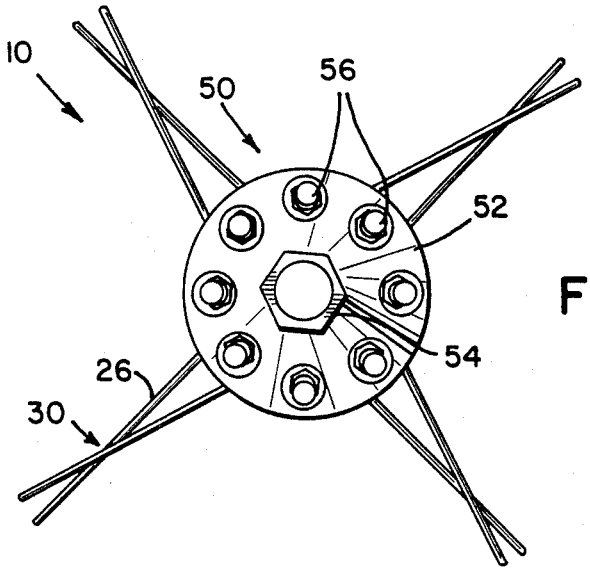
Figure 3:
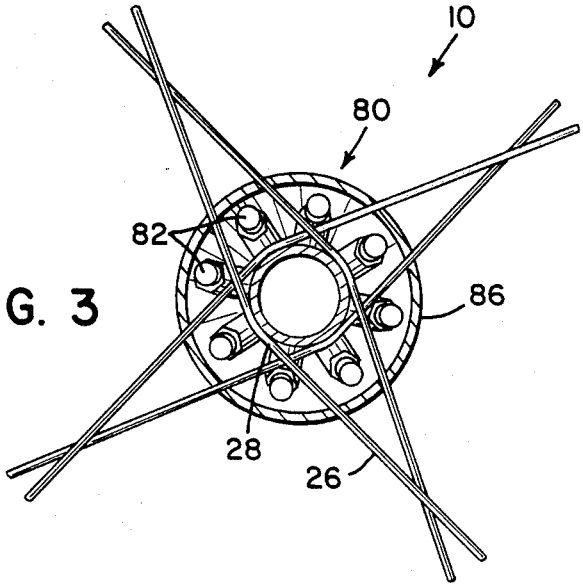
Figure 4:
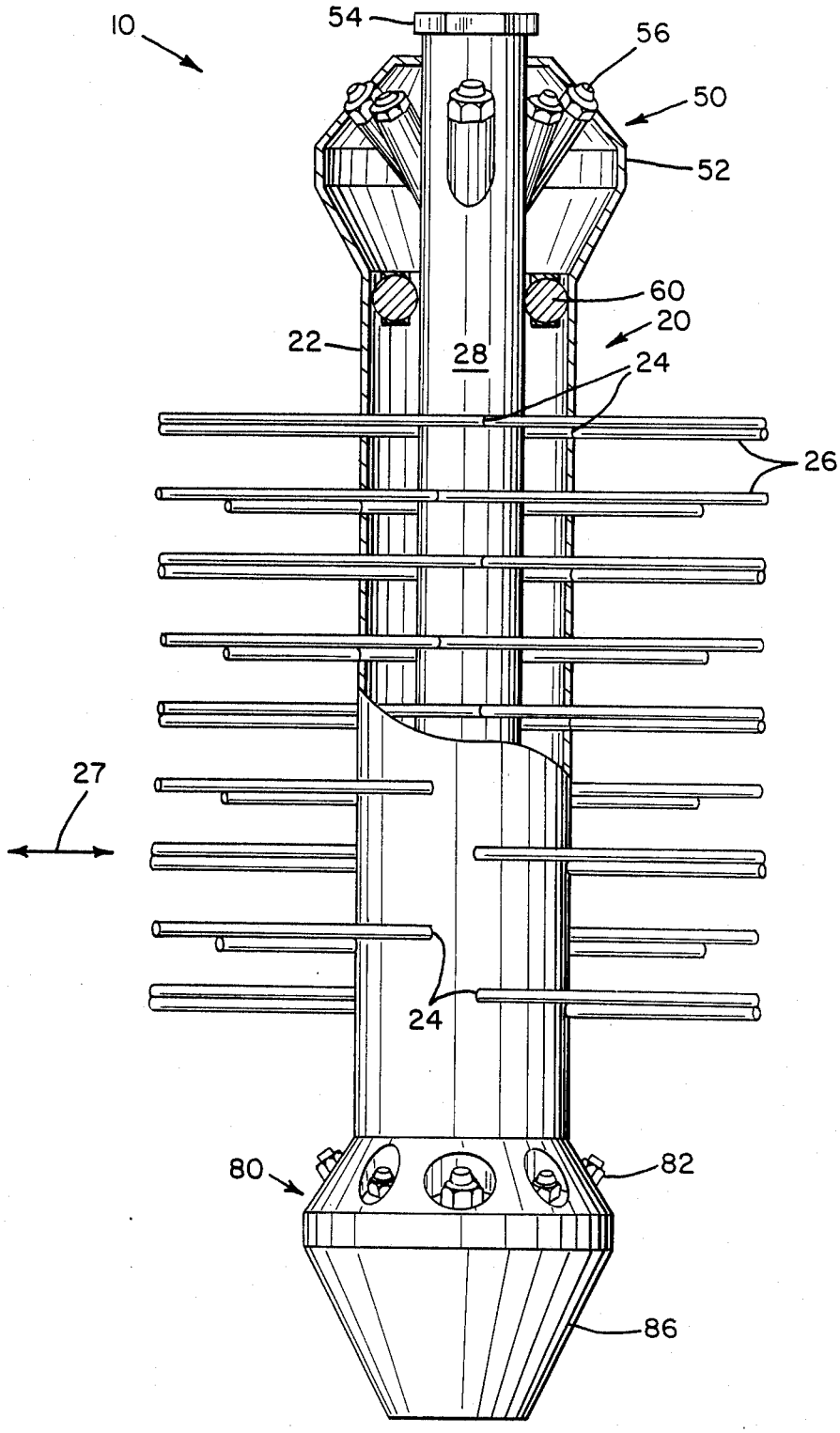

FIG. III depicts a partial cut away view of sewer cleaning device 10 to show front or sealed nozzle housing 80 as seen from rear nozzle housing 50.

FIG. IV depicts a partial cut away view of sewer cleaning device 10.

Throughout the figures of the drawing, where the same part appears in more than one figure, the same numeral is applied thereto.

DESCRIPTION OF THE PREFERRED EMBODIMENTS

A sewer cleaning device combining with high pressure water with scraping provides a highly efficient manner of cleaning a sewer.

Referring now to FIG. I, sewer cleaning device 10 is depicted in a perspective view. Sewer cleaning device 10 includes a scraper housing 20, having an inlet nozzle housing 50 secured at one end thereof and a sealed nozzle housing 80 secured at the other end thereof and oppositely disposed from rear nozzle housing 50.

Turning now to scraper housing 20, scraper housing 20 includes a perforated cylinder 22 to which inlet nozzle 50 and sealed nozzle 80 are attached. Perforated cylinder 22 has a plurality of perforations 24 therein to permit cables 26 to be inserted through perforations 24. Thus one cable 26 is inserted through a pair of perforations 24. After insertion, cable 26 is held frictionally in each pair of perforations 24.

Generally, perforations 24 are positioned, so that cables 26 are inserted in a symmetrical pattern. Cables 26 form a plurality of cable planes 27, with each cable plane 27 being substantially perpendicular to the cylindrical axis of perforated cylinder 22. Each of cables 26 generally intersects another cable 26 to form an X-shaped pattern. While it is not desired to be bound by any particular theory, it is believed that support between cables 26 permits increased scraping efficiency.

Each cable plane 27 contains a plurality of X-shaped or cross intersections 30 of cables 26. Sufficient perforations 24 are formed in scraper housing 20 to make the desired number of X-shaped intersections 30. The cables 26 generally intersect at points based on the cylindrical axis of perforated cylinder 22. Generally, X-shaped intersections 30 are 20° to 180° separated in cable plane 27. More preferred, intersections 30 are 30° to 120° separated in cable plane 27. Still more preferred, X-shaped intersections 30 are 60° to 120° spearated in cable plane 27. Most preferred, the cables 26 generally intersect at points 90° (as based on the cylindrical axis of perforated cylinder 22) from each other. Of course, other suitable cable patterns—both symmetrical and non symmetrical—may be used. It is found however, that this crossing of the cables 26 at 90° as inserted in the perforations 24 permit for the efficient cleaning of the sewer.

Referring now to FIG. II, an end view of inlet nozzle housing 50 is depicted. Inlet nozzle housing 50 includes an inlet nozzle head 52. Inlet nozzle head 52 is the cap that fits on perforated cylinder 22 and is welded or otherwise secured thereto. Inlet nozzle head 52 has centrally located therein a female thread assembly 54 suitable for receiving a sewer jet (not shown) or a standard rotatable device which can then be attached to the sewer jet. With the sewer jet, water is fed through female thread assembly 54 into water pipe 28 and out of front sewer nozzles 82 and rear nozzles 56 at high pressure, in order to permit device 10 to function. If the standard rotatable device (also not shown) is used on the sewer jet, the sewer cleaning device rotates as it moves longitudinally through the sewer. Such rotational movement is not usually necessary because just the straight drive from the sewer jet applied is the sewer cleaning device 10 and is sufficient to move and destroy whatever sewer clog is present.

Within the inlet nozzle head 52 are eight rear nozzles 56 at substantially an acute angle with the axis of symmetry of the sewer cleaning device 10. Rear nozzles are equally and radially spaced about inlet nozzle 52. These nozzles provide high pressure water which both serve to propel the sewer cleaning device through the sewer, and to wash clogs and other material off the walls of the sewer pipe. This high pressure water, in combination with the cables 26, provide tremendously efficiently cleaning of the sewer pipe.

Referring now to FIG. III, a partial cross-section view of sealed nozzle housing 80 is shown. Sealed nozzle housing 80 includes sealed nozzle head 86 having front sewer nozzles 82 therein. The sewer front nozzles 82 are shown at angles in the same fashion as the rear nozzles 56. In this fashion, both rear nozzles 56 and front nozzles 82 are aimed toward the rear portion or inlet nozzle housing 50, so that water flowing therethrough comes out of nozzles 56 with sufficient force to propel the sewer cleaning device 10 through the sewer. The nozzles 56 are welded or otherwise secured in the nozzle housings and are fed by the sewer jet.

The sewer front nozzles 82 are shown at angles in the same fashion as the rear nozzles 56. Generally the nozzles are at an angle of 10° to 75° from the cylindrical axis of the perforated cylinder 22. More preferably, the nozzles are at an angle of 15° to 60° from the cylindrical axis of the perforated cylinder 22. Even more preferrably, the nozzles are at an angle of 20° to 45° from the cylindrical axis of the perforated cylinder 22. Most preferrably, the nozzles are at an angle of 25° to 35° from the cylindrical axis of the perforated cylinder 22. As can be seen in FIG. I, in a preferred form, alternate nozzles are aimed along the intersection 30 line of sight.

Referring now to FIG. IV, a side, partial-cut away view of sewer cleaning device 10 is depicted. More particularly, scraper housing 20 is shown in partial-cut away view and water pipe 28 is shown therein. The cut away view of scraper housing 20 shows the positioning of perforations 24 and of cables 26 so that it becomes clear how cables 26 and perforations 24 are used. Basically, perforations 24 are drilled in pairs so that the pieces of cable 26 may be received therethrough. Any pattern is suitable, but it is belived that the crossing intersections 30 of cable 26 being at 90° angles from each other around scraper housing 20 provides the best and most efficient cleaning.

It furthermore becomes clear that pipe 28 carries water to and through rear nozzles 56 and front nozzles 82. The nozzles are welded or otherwise secured to the water pipe 28 in order to be fed water through water pipe 28, and supported by the inlet nozzle head 52 and sealed nozzle head 86. Both rear nozzles 56 and front nozzles 82 communicate with pipe 28 in a water-tight fashion to permit water flow through pipe 28 at female threaded assembly 54 and out of rear nozzles 56 and front nozzles 82. In this fashion, substantial strength is added to the positioning of the nozzles. It is also feasible to use adjustable nozzles and be able to aim the nozzles as desired to compensated for the particular cleaning desired.

Water pipe 28 is concentrically supported in scraper housing 20 by by circular brace 60 adjacent to rear nozzle head 52. A similar brace 60 is positioned adjacent sealed nozzle head 86. Braces 60 are optional and add support to between water pipe 28 and scraper housing 20. Securing for braces 60 is accomplished by welding or other suitable fastening methods.

Suitable materials for sewer cleaning device 10 include basically durable solid metallic material. Cables 26 may be made of any suitable woven wire cable or stiff plastic cable as desired. Other parts of the device may be replaced with suitable synthetic resin or plastics provided they have the required durablity and strength to withstand the high pressure water anad the brute force required to push the sewer cleaning device through a clogged sewer.

Because of this disclosure and solely because of this disclosure, other modifications of this device may become clear to a person having ordinary skill in this art. Such modifications are clearly covered hereby.

What is claimed and sought to be secured by letters Patent by the United States is:

1. A device for cleaning a sewer capable of being attached to a sewer jet wherein:
   a. a housing having a water conveying tube and a central perforated cylinder is provided for said device;
   b. an inlet nozzle assembly is secured to a first end of said housing;
   c. a sealed nozzle assembly is secured to a second end of said housing and oppositely disposed from said inlet nozzle assembly;
   d. said inlet nozzle assembly and said sealed nozzle assembly each include a plurality of high pressure nozzles;
   e. said water conveying tube connects said high pressure nozzles of said inlet nozzle assembly and said sealed nozzle assembly to provide for water flow through said high pressure nozzles;
   f. said housing further includes said central perforated cylinder for said housing between said inlet nozzle assembly and said sealed nozzle assembly surrounding said water conveying tube; and
   g. a plurality of stiffened cables are mounted in said central perforated cylinder.

2. The device of claim 1 wherein:
   a. said perforatd cylinder has a plurality of perforations through which said stiffened cables are mounted; and
   b. said stiffened cables form a plurality of X-shaped cable patterns above the surface of said perforated cylinder.

3. The device of claim 2 wherein said X-shaped cable patterns are symmetrically spaced.

4. The device of claim 3 wherein:
a. said water conveying tube and said central perforated cylinder are substantially concentric with water conveying tube being interior to said central perforated cylinder;
b. said inlet nozzle assembly includes an inlet nozzle housing, an inlet nozzle head, and a plurality of rear nozzles;
c. said inlet nozzle housing is secured to said perforated cylinder and to said water conveying tube; and
d. a securing means for attaching said device to said sewer jet is centrally located in said inlet nozzle housing.

5. The device of claim 4 wherein:
a. a plurality of said high pressure nozzles are mounted in said inlet nozzle housing and in water-flow communication with water conveying tube;
b. a plurality of said high pressure nozzles are mounted in said sealed nozzle housing an in water-flow communication with water conveying tube; and
c. said water-flow through said high-pressure nozzles propels said device through said sewer.

6. The device of claim 5 wherein said high-pressure nozzles are aimed toward said securing means at an angle of about 10° to about 75° from a cylindrical axis of said water conveying tube.

7. The device of claim 6 wherein a rotational means for providing rotation of said device during a cleaning process is secured between said device and said sewer jet to provide rotational and longitudinal movement of said device through said sewer.

8. The device of claim 7 wherein said securing means is a female threaded assembly suitable for receiving said rotational means.

9. The device of claim 6 wherein said securing means is a female threaded assembly suitable for receiving said sewer jet.

10. The device of claim 9 wherein said securing means is a female threaded assembly suitable for receiving said rotational means.

11. The device of claim 10 wherein:
a. said plurality of said high pressure nozzles mounted in said inlet nozzle housing and in water-flow communication with water conveying tube number eight nozzles and are mounted symmetrically;
b. said plurality of said high pressure nozzles mounted in said sealed nozzle housing and in water-flow communication with water conveying tube number eight nozzles and are mounted symmetrically.

12. The device of claim 11 wherein said high-pressure nozzles are aimed toward said securing means at an angle of about 15° to about 60° from a cylindrical axis of said water conveying tube.

13. The device of claim 12 wherein said high-pressure nozzles are aimed toward said securing means at an angle of about 20° to about 45° from a cylindrical axis of said water conveying tube.

14. The device of claim 13 wherein said high-pressure nozzles are aimed toward said securing means at an angle of about 25° to about 35° from a cylindrical axis of said water conveying tube.

15. The device of claim 14 wherein:
a. at least one set of said X-shaped cable patterns are symmetrically spaced and co-planar; and
b. each intersection point of said set are spaced from 60° to 120° apart.

16. The device of claim 15 wherein each intersection point of said set are spaced from 80° to 100° apart.

17. A device for cleaning a sewer capable of being attached to a sewer jet wherein:
a. a housing is provided for said device;
b. an inlet nozzle assembly is secured to a first end of said housing;
c. a sealed nozzle assembly is secured to a second end of said housing and oppositely disposed from said inlet nozzle assembly;
d. said inlet nozzle assembly and said sealed nozzle assembly each include a plurality of high pressure nozzles;
e. a water conveying tube connects said high pressure nozzles of said inlet nozzle assembly and said sealed nozzle assembly to provide for water flow through said high pressure nozzles;
f. said housing further includes a central perforated cylinder for said housing between said inlet nozzle assembly and said sealed nozzle assembly surrounding said water conveying tube; and
g. said perforated cylinder has a plurality of perforations through which a stiffened cables are mounted;
h. said stiffened cables form a plurality of X-shaped cable patterns above the surface of said perforated cylinders;
i. said water conveying tube and said central perforated cylinder are substantially concentric with water conveying tube being interior to said central perforted cylinder;
j. said inlet nozzle assembly includes an inlet nozzle housing, an inlet nozzle head, and a plurality of rear nozzles;
k. said inlet nozzle housing is secured to said perforated cylinder and to said water conveying tube;
l. a securing means for attaching said device to said sewer jet is centrally located in said inlet nozzle housing;
m. eight of said high pressure nozzles are symmetrically mounted in said inlet nozzle housing and in water-flow communication with water conveying tube;
n. eight of said high pressure nozzles are symmetrically mounted in said sealed nozzle housing and in water-flow communication with water conveying tube;
o. said water-flow through said high-pressure nozzles propels said device through said sewer;
p. a female threaded assembly is centrally located in said inlet nozzle for securing said device to said sewer jet;
q. said high-pressure nozzles are aimed toward said securing means at an angle of about 25° to about 35° from a cylindrical axis of said water conveying tube; and
r. each coplanar set of X-shaped cable pattern have intersection points of each X said set spaced 90° degrees apart.

18. The device of claim 17 wherein a rotational means for providing rotation of said device during a cleaning process is secured between said device and said sewer jet to provide rotational and longitudinal movement of said device through said sewer.

19. A method for cleaning a sewer comprising forming a device using high pressure water and a scraping means, securing said device to a sewer jet, running water through said sewer jet into said device and out through high-pressure nozzles, wherein:

a. a housing is provided for said device;

b. an inlet nozzle assembly is secured to a first end of said housing;

c. a sealed nozzle assembly is secured to a second end of said housing and oppositely disposed from said inlet nozzle assembly;

d. said inlet nozzle assembly and said sealed nozzle assembly each include a plurality of high pressure nozzles;

e. a water conveying tube connects said high pressure nozzles of said inlet nozzle assembly and said sealed nozzle assembly to provide for water flow through said high pressure nozzles;

f. said housing further includes a central perforated cylinder for said housing between said inlet nozzle assembly and said sealed nozzle assembly surrounding said water conveying tube; and g. said perforated cylinder has a plurality of perforations through which a stiffened cables are mounted;

h. said stiffened cables form a plurality of X-shaped cable patterns above the surface of said perforated cylinders;

i. said water conveying tube and said central perforated cylinder are substantially concentric with water conveying tube being interior to said central perforated cylinder;

j. said inlet nozzle assembly includes an inlet nozzle housing, an inlet nozzle head, and a plurality of rear nozzles;

k. said inlet nozzle housing is secured to said perforated cylinder and to said water conveying tube;

l. a securing means for attaching said device to said sewer jet is centrally located in said inlet nozzle housing;

m. eight of said high pressure nozzles are mounted in said inlet nozzle housing and in water-flow communication with water conveying tube;

n. eight of said high pressure nozzles are mounted in said nozzle housing and in water-flow communication with water conveying tube;

o. said water-flow through said high-pressure nozzles propels said device through said sewer;

p. a female threaded assembly is centrally located in said inlet nozzle for securing said device to said sewer jet;

q. said high-pressure nozzles are aimed toward said securing means at an angle of about 25° to about 35° from a cylindrical axis of said water conveying tube; and r. each coplanar set of X-shaped cable pattern have intersection points of each X said set spaced 90° degrees apart.

20. The method of claim 19 wherein a rotational means for providing rotation of said device during a cleaning process is secured between said device and said sewer jet to provide rotational and longitudinal movement of said device through said sewer.

* * * * *